US007454878B2

(12) United States Patent
Bradley

(10) Patent No.: US 7,454,878 B2
(45) Date of Patent: Nov. 25, 2008

(54) ANTI-ROTATION NECK SUPPORT KNIFE

(75) Inventor: Gerald R. Bradley, 8615 C.R. 4074, Scurry, TX (US) 75158

(73) Assignee: Gerald R. Bradley, Scurry, TX (US)

( * ) Notice: Subject to any disclaimer, the term of this patent is extended or adjusted under 35 U.S.C. 154(b) by 0 days.

(21) Appl. No.: 10/414,388

(22) Filed: Apr. 15, 2003

(65) Prior Publication Data

US 2004/0206047 A1 Oct. 21, 2004

(51) Int. Cl.
*B65B 7/28* (2006.01)

(52) U.S. Cl. ..... 53/300; 53/317; 53/331.5; 53/490

(58) Field of Classification Search ..... 53/331, 53/331.5, 367, 300, 317, 490
See application file for complete search history.

(56) References Cited

U.S. PATENT DOCUMENTS 1,041,527 A * 10/1912 Taylor ..... 53/300
4,114,347 A * 9/1978 Morris et al. ..... 53/300
4,939,890 A * 7/1990 Peronek et al. ..... 53/486
5,408,801 A * 4/1995 Molinaro ..... 53/300
5,689,932 A * 11/1997 Peronek et al. ..... 53/201
6,334,289 B1 * 1/2002 Buchel ..... 53/201
7,162,849 B2 * 1/2007 Bernhard ..... 53/317
2002/0116897 A1 * 8/2002 Higashizaki et al. ..... 53/331.5
2003/0056468 A1 * 3/2003 Masumoto ..... 53/317
2004/0006951 A1 * 1/2004 Riggs et al. ..... 53/490

OTHER PUBLICATIONS

Arol, Neck Support Knife; Arol S.p.A., Canelli, Italy; 4 photographs, admitted prior art.

* cited by examiner

*Primary Examiner*—Thanh K Truong
(74) *Attorney, Agent, or Firm*—Carr LLP

(57) ABSTRACT

A neck support knife for supporting a bottle during capping includes an arcuate planar surface having a plurality of elongated cleats extending away from the planar surface and arranged in a radial pattern. The cleats have a tooth-like vertical cross-section. An inner arcuate face adjoins the planar surface and engages the bottle neck during operation. On each cleat, the corner nearest the inner arcuate face is shaped to reduce contact with the bottle flange/neck junction. In a preferred embodiment, the cleats are all canted from the radial orientation in the same direction so that the bottle is biased against the inner arcuate face during capping.

14 Claims, 3 Drawing Sheets

ANTI-ROTATION NECK SUPPORT KNIFE

TECHNICAL FIELD

This invention relates in general to automated capping equipment in the bottling industry. In particular, the invention relates to an improved neck support knife for use in a bottle capping machine.

DESCRIPTION OF THE RELATED ART

Plastic bottles for beverages are commonly manufactured with a flange around the neck for use while installing a screw-on cap onto the bottle. A neck support knife supports the bottle along part of the underside of the flange. The weight of the filled bottle and the downward force applied to the cap create friction that holds the bottle in place during capping. This friction is often insufficient to hold the container in place properly while the cap is rotated, so that the bottle spins atop the neck support knife and the cap is not properly applied.

Various features have been added to the convention flat-top knife to eliminate this problem. On one device, a plurality of pointed pins extend up from the flat support surface to bite into the flange. These pins improve the rotation resistance over a flat surface, but are still inadequate in most cases. In another device, three elongated cleats with a sawtooth profile are spaced about the length of the flat support surface and oriented along radial lines, as shown in FIG. 1. These provided better rotation resistance than the pointed pins, but in many cases the bottle flange will still slip and the bottle will rotate. When this happens, the cleats tend to shave long strands of plastic away from the flange, which hang off the flange and are visually undesirable. Also, the cleats tend to wear out quickly, and they distort and gouge the flange even when they do prevent rotation, giving an undesirable appearance to the bottle. The maker of this device has recently replaced this device with the one shown in FIG. 2. In this device, the cleat profile is made up of three segments: a pair of concave curves and a straight vertical surface. These three segments define two hollow-ground teeth of unequal height as shown in FIG. 3. This profile requires a great deal of machining, adding significantly to the cost of fabrication. The hollow-ground teeth will likely have a short life span.

A need remains for a neck support knife that can engage a neck flange and prevent rotation without the drawbacks of the prior art devices. Preferably, the knife should be fabricated with minimal machining.

SUMMARY OF THE INVENTION

In general, a neck support knife having the desired features and advantage is achieved with an arcuate, substantially planar surface adapted to engage a flange on the neck of a container such as a beverage bottle, and five elongated cleats extending up from the planar surface and oriented predominantly in a radial pattern around the planar surface. The cleats are spaced evenly about the length of the arcuate planar surface, and each cleat has a tooth-like vertical profile adapted to engage and dig into the flange, preventing the bottle from rotating during the capping process. Preferably, the end of the cleat adjoining the inner arcuate face (i.e. the side contacting the bottle neck) is shaped with a bevel, radius or similar feature to help the cleat interface properly with the contour of the bottle neck/flange junction.

Until now, the general belief has been that using more than three evenly spaced cleats has no benefit, because dividing the total top load (i.e. the downward force applied to the cap during rotation) among so many cleats would result in each cleat not providing sufficient grip to prevent rotation of the flange. However, not only do five evenly spaced cleats provide adequate rotation prevention, but the required top load is dramatically reduced, which was an unexpected result. Likewise, the magnetic clutch for the cap chuck can be set at a lower setting, which can extend the life span of the clutch. Also, the use of five cleats reduces the variation in the cap retaining torque from bottle to bottle down to as little as one fifth the amount with prior art knives. This reduction in cap retaining torque variation was also unexpected and a dramatic improvement over the prior art.

In a preferred alternate embodiment, the cleats are canted by up to about twenty degrees from a radial direction. The canting improves the capping process by drawing the bottle in against the neck support knife, which simultaneously improves rotation resistance and more accurately and repeatably positions the bottle in the machinery. Performance is improved further by beveling or otherwise shaping the inner end of each cleat as previously discussed.

In all embodiments, the use of more cleats has resulted in an unexpectedly dramatic improvement in the usable life span for the cleats. Testing has shown a minimum of fifty percent to as much as several times the life span of prior art cleated neck support knives.

Additional features and advantages of the invention will become apparent in the following detailed description and in the drawings.

DESCRIPTION OF THE PREFERRED EMBODIMENT

Figure 1:
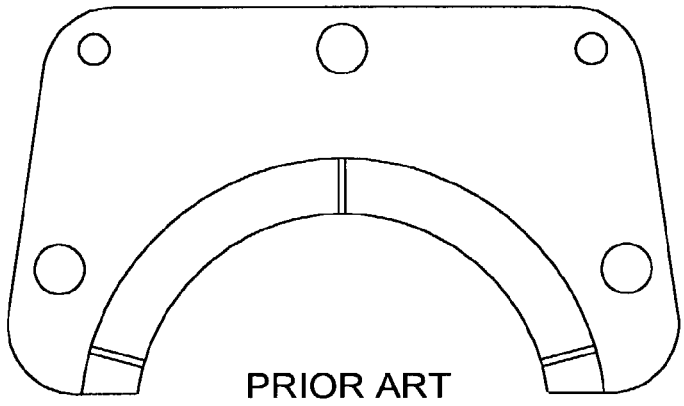
FIG. 1 is a top plan view of a prior art neck support knife.
Figure 2:
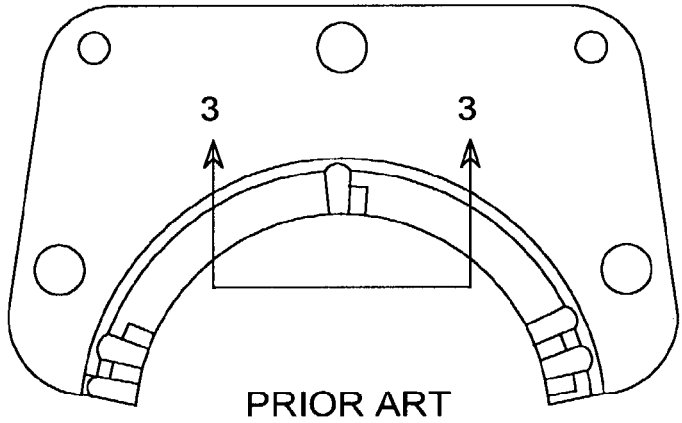
FIG. 2 is a top plan view of a second prior art neck support knife.
Figure 4:
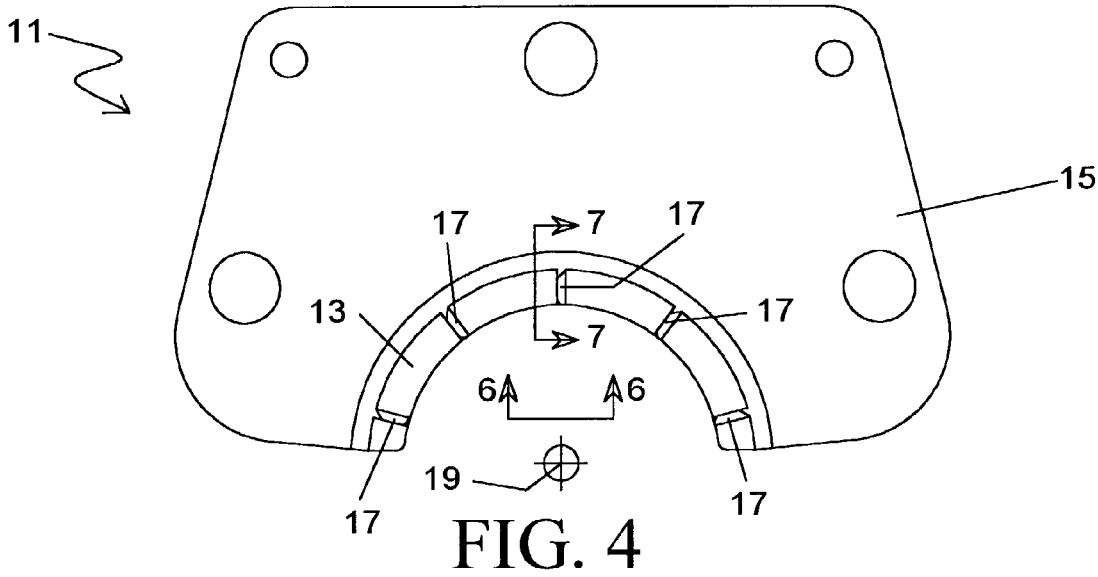
FIG. 4 is a top plan view of a neck support knife according to the invention.

FIG. 4 shows a neck support knife 11 in accordance with the invention, for comparison with the closest known prior art depicted in FIGS. 1 and 2. In the various drawings, equivalent elements are given the same reference numbers. Also, the drawing figures are not necessarily to scale and in certain views proportions may have been exaggerated for clarity.

Figure 9:
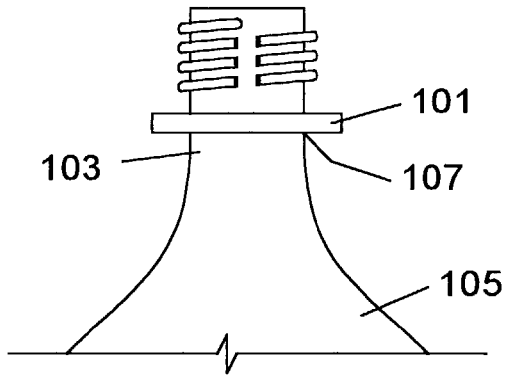
FIG. 9 is a front elevation of the upper portion of a typical bottle supported by the invention during use.

The improved neck support knife 11 includes a planar surface 13 surrounded by a rim 15 adapted for attachment to a capping machine (not shown). The planar surface 13 is arcuate in shape; the total included angle of the arc can be varied over a fairly wide range but typically is roughly semi-circular. Similarly, the shape and arrangement of mounting holes in the rim 15 can be modified as needed to match the configuration required for attachment to a particular capping machine. The planar surface 13 is adapted to engage and support a flange 101 extending from the neck 103 of a bottle 105 (FIG. 9) that rests on the planar surface 13, with the bottle body suspended below the neck support knife 11.

Five uniformly spaced, substantially identical elongated cleats 17 rise up off the planar surface 13. Each cleat 17 is aligned with its major dimension substantially along a radius from a center axis 19 perpendicular to the planar surface 13. Substantially even spacing between cleats 17 is considered important to help prevent slippage. With unevenly spaced cleats as in the prior art device of FIG. 2, the bottle flange 101 can flex enough to contact the planar surface 13 prematurely, thereby limiting the cleats's ability to engage the flange. At the same time, total contact area between the bottle flange and the planar surface is reduced, resulting in less friction to aid in preventing bottle rotation.

Figure 5:
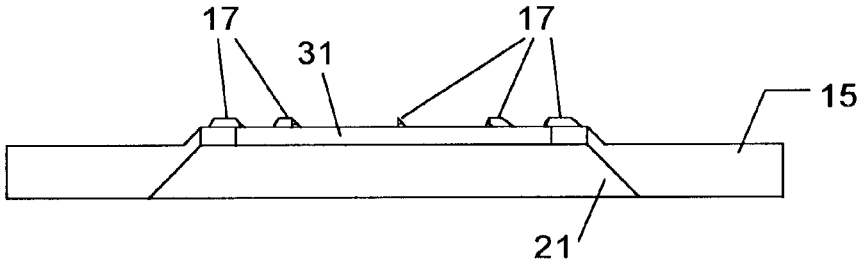
FIG. 5 is a front elevation thereof.

In FIG. 5 the inner arcuate face 31 and the underside 21 can be seen. The underside 21 is substantially parallel under the planar surface 13, changing to a sloping shoulder for increased rigidity while still providing clearance for the bottle. Different shapes can be used for the underside as desired. The inner arcuate face 31 can also be varied in height and shape as required.

Figure 3:
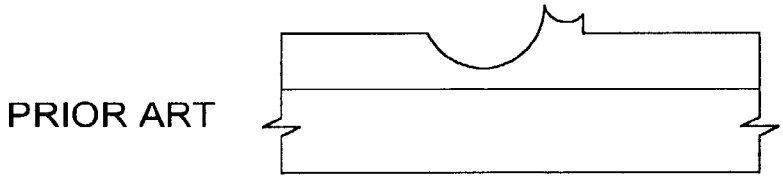
FIG. 3 is a front edge detail view of the cleat and the surrounding knife surface as seen along the lines 3-3 in FIG. 2.
Figure 6:
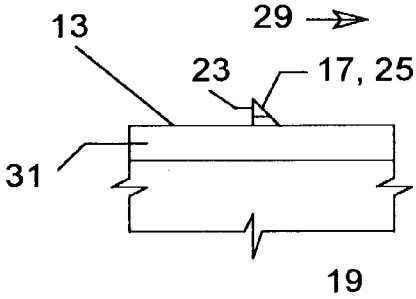
FIG. 6 is a detailed front elevation as seen along lines 6-6 in FIG. 4 to show more clearly the features of the cleat vertical cross section.

FIG. 6 shows a detail of the middle cleat, with the other cleats being substantially identical. Each cleat 17 has a tooth-like vertical cross-section, where the term tooth-like is defined as having two sides forming an acute angle. The sides of the cleat can be straight or slightly convex, but should not be concave as in the detail of FIG. 3. Preferably, the vertical cross section resembles a right triangle with the right angle defined between the plane containing the planar surface 13 and a vertical side 23 (i.e. the vertical side 23 is perpendicular to the planar surface 13). The angle 27 between the hypotenuse 25 and the vertical side 23 is preferably between about forty-five degrees and about sixty degrees, and varies inversely with the hardness of the plastic used to make the bottle, i.e. the softer the plastic, the larger the angle. The height of the vertical side 23 can vary slightly, but preferably is about thirty thousandths of an inch (0.76 millimeters). The height is selected so that the bottle flange 101 will not flex excessively before contacting the planar surface 13. The bottle flange 101 (FIG. 9) will attempt to move relative to the cleat 17 in the direction indicated by the arrow 29.

Figure 7:
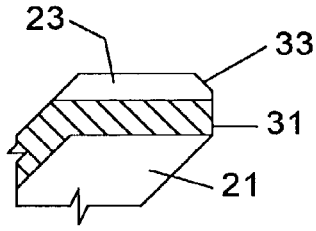
FIG. 7 is a cross-sectional left side elevation of the area surrounding the cleat as seen along lines 7-7 of FIG. 4.

The interaction between the cleats 17 and the bottle flange 101 tends to bias the bottle neck 103 toward the inner arcuate face 31. The junction 107 of the bottle flange 101 and the neck 103 is not perfectly square, but typically has a radius of about fifteen thousandths of an inch (0.38 millimeters). When the cleats 17 have square corners on the ends adjoining the inner arcuate face 31, the bottle junction 107 engages the cleats prematurely and erratically, causing variation in capping performance. Uniformity of capping torque is greatly improved by shaping the end of the cleat. The preferred method is to machine a forty-five degree bevel 33 about twenty thousandths of an inch (0.51 millimeters) on a side at the corner of the cleat 17 as shown in FIG. 7. With the bevel, the corner will just clear the radius in the bottle neck/flange junction 107. The corner can also be radiused to match the radius of the junction 107, but this requires more time and care to machine properly.

Figure 8:
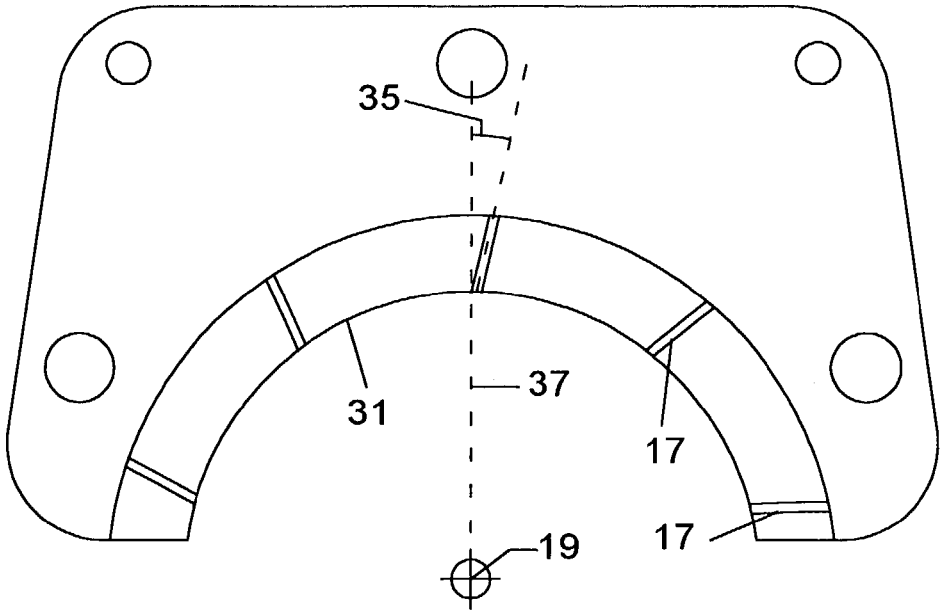
FIG. 8 is a top plan view of an alternative embodiment of the neck support knife having the cleats canted from the radial orientation of FIG. 4.

An alternative embodiment is shown in FIG. 8. In this embodiment, each cleat 17 is oriented with its major dimension canted from a radius 37 drawn through the center axis 19. The canting angle 35 formed between a particular cleat 17 and its radius 37 can be varied from slightly greater than zero to a maximum of about twenty degrees. Canting the cleats significantly increases the force biasing the bottle neck 103 against the inner arcuate face 31 during capping. This helps to properly position the bottle, which should result in even less variation in cap retaining torque than the embodiment of FIG. 4. The corners of the cleats can also be beveled as in FIG. 7.

The invention has been shown in several embodiments. It should be apparent to those skilled in the art that the invention is not limited to these embodiments, but is capable of being varied, modified and improved without departing from the scope of the invention as set out in the attached claims.

What is claimed is:

1. A neck support knife for use in an automated capping machine used to put caps on a container having a neck with a flange, the neck support knife comprising:

a substantially planar surface having a recess surrounding a central area adapted to receive a container neck;

an array of five elongated substantially evenly spaced cleats rising away from the substantially planar surface, the cleat array at least partially surrounding the central area and the cleat array adapted to engage a flange of a container neck located in the central area;

each cleat having a tooth-like cross-sectional profile forming a ridge along the top of each cleat, the ridge extending in a generally radial direction away from the recess and the ridge having a length greater than the width of the cleat at the substantially planar surface; and each cleat having a substantially planar gripping surface extending from the ridge toward and substantially perpendicular to the substantially planar surface.

2. A neck support knife as recited in claim 1, wherein the recess surrounding the central area comprises an inner arcuate face adjoining the substantially planar surface, and wherein the corner of each cleat nearest the inner arcuate face is shaped to reduce contact with the junction formed between the bottle neck and the bottle flange.

3. A neck support knife as recited in claim 1, wherein the cleat cross-sectional profile is a substantially right triangle having a vertical side perpendicular to the substantially planar surface, and wherein the acute angle between the hypotenuse and the vertical side is between about forty-five degrees and about sixty degrees.

4. A neck support knife as recited in claim 3, wherein the vertical side is about thirty-thousandth of an inch (0.030 inches) high.

5. A neck support knife for use in an automated capping machine used to put caps on a container having a neck with a flange, the neck support knife comprising:

a substantially planar surface adapted to receive and support a container neck flange;

an arcuate face adjoining the planar surface for receiving at least a portion of a container neck having a neck flange extending in a radial direction;

a plurality of elongated cleats rising away from the planar surface and adapted to engage the flange, each cleat having a substantially continuous tooth-like cross-sectional profile forming a ridge along the top of each cleat, the ridge extending in a generally radial direction away from the arcuate face and the ridge having a length greater than the width of the cleat at the substantially planar surface; and wherein at least a portion of the end of each cleat nearest the arcuate face recedes away from the arcuate face toward the top of the cleat, to reduce contact with the junction formed between the bottle neck and the bottle flange.

6. A neck support knife as recited in claim 5, wherein each cleat has a tooth-like cross-sectional profile.

7. A neck support knife as recited in claim 6, wherein the cleat cross-sectional profile is a substantially right triangle having one side perpendicular to the substantially planar surface.

8. A neck support knife as recited in claim 7, wherein the side perpendicular to the substantially planar surface is about thirty-thousandth of an inch (about 0.030 inches) high.

9. A neck support knife for use in an automated capping machine used to put caps on a container having a neck with a flange, the neck support knife comprising:

a substantially planar surface adapted to receive and support a neck flange;

a plurality of elongated spaced cleats rising away from the substantially planar surface and adapted to engage a neck flange received by the planar surface, each cleat having a substantially elongated upper edge extending substantially continuously along the cleat and having a length in a radial orientation substantially perpendicular to a center axis greater than the width of the cleat measured perpendicular to the upper edge, wherein the center axis is positioned beyond an edge of the substantially planar surface and is normal to the planar surface; and each cleat having a tooth-like cross-sectional profile, and a substantially planar surface extending from the upper edge of the cleat to intersect substantially perpendicularly with the substantially planar surface.

10. A neck support knife as recited in claim 9, further comprising an inner arcuate face adjoining the planar surface, and wherein the corner of each cleat nearest the center axis is shaped to reduce contact with the junction formed between a container neck and the neck flange.

11. A neck support knife as recited in claim 9, wherein the cleat cross-sectional profile is a substantially right triangle having a vertical side perpendicular to the substantially planar surface, and wherein the acute angle between the hypotenuse and the vertical side is between about forty-five degrees and about sixty degrees.

12. A neck support knife as recited in claim 11, wherein the vertical side is about thirty-thousandth of an inch (0.030 inches) high.

13. A neck support knife for use in an automated capping machine used to put caps on a container having a neck with a flange, the neck support knife comprising:

a substantially planar surface having an arcuate edge adapted to receive and support a neck flange;

a plurality of elongated spaced cleats rising away from the planar surface and adapted to engage a neck flange, each cleat having a substantially elongated upper edge extending in a generally radial orientation substantially perpendicular with respect to a center axis normal to the planar surface and having a tooth-like cross-sectional profile, the length of the upper edge of each cleat being greater than the width of the cleat at the planar surface; and wherein the substantially elongated upper edge is about thirty-thousandth of an inch (0.030 inches) away from the planar surface.

14. A neck support knife for use in an automated capping machine configured to receive a container having a neck with a flange, the neck support knife comprising:

a substantially planar surface adapted to receive and support a flange and comprising at least one arcuate edge;

five elongated spaced cleats protruding from the planar surface and adapted to engage a flange such that flange substantially seats on the planar surface between the cleats, each cleat comprising a substantially elongated upper edge with a major dimension in a generally radial orientation substantially perpendicular with respect to a center axis normal to the planar surface and further comprising a tooth-like cross-sectional profile, the major dimension comprising the length of the upper edge extending in the radial orientation with respect to the center axis and the major dimension being greater than the widest portion of the cleat extending perpendicular to the upper edge; and each cleat configured such that the upper edge rises about thirty-thousandth of an inch (0.030 inches) above the planar surface.

* * * * *